US007217895B1

(12) United States Patent
Shea et al.

(10) Patent No.: US 7,217,895 B1
(45) Date of Patent: May 15, 2007

(54) ELECTRICAL SWITCHING APPARATUS CONTACT ASSEMBLY AND MOVABLE CONTACT ARM THEREFOR

(75) Inventors: John J. Shea, Pittsburgh, PA (US); Jeffrey A. Miller, McKees Rocks, PA (US); Brian J. Schaltenbrand, Cranberry Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/481,540

(22) Filed: Jul. 6, 2006

(51) Int. Cl.
*H01H 1/22* (2006.01)

(52) U.S. Cl. ..... 200/244; 218/146; 335/16

(58) Field of Classification Search ..... 200/244, 200/238, 288, 248; 218/22, 30, 32, 33; 335/16, 335/46, 147, 193, 195
See application file for complete search history.

(56) References Cited

U.S. PATENT DOCUMENTS

| | | | | |
|---|---|---|---|---|
| 2,211,412 | A | 8/1940 | Filko | |
| 3,267,243 | A * | 8/1966 | Dotto | 200/244 |
| 3,646,488 | A | 2/1972 | Iida et al. | |
| 4,281,303 | A * | 7/1981 | Heft | 335/16 |
| 4,482,877 | A * | 11/1984 | Castonguay et al. | 335/191 |
| 4,527,027 | A | 7/1985 | Link et al. | |
| 4,849,590 | A | 7/1989 | Becker et al. | |
| 5,029,301 | A | 7/1991 | Nebon et al. | |
| 5,367,276 | A * | 11/1994 | Castonguay | 335/16 |
| 5,517,164 | A * | 5/1996 | Zoller et al. | 335/16 |
| 5,910,760 | A | 6/1999 | Malingowski et al. | |
| 6,184,761 | B1 * | 2/2001 | Doma et al. | 335/16 |
| 6,452,470 | B1 | 9/2002 | Malingowski et al. | |
| 6,563,407 | B2 * | 5/2003 | Kramer | 335/16 |
| 6,717,089 | B1 * | 4/2004 | Azzola et al. | 218/146 |
| 6,831,536 | B1 | 12/2004 | Zindler | |
| 6,878,890 | B1 * | 4/2005 | Stay et al. | 200/244 |
| 6,924,445 | B2 * | 8/2005 | Bresciani et al. | 200/244 |

* cited by examiner

*Primary Examiner*—Michael A. Friedhofer
(74) *Attorney, Agent, or Firm*—Martin J. Moran

(57) ABSTRACT

A contact assembly for a circuit breaker includes a fixed contact, a movable contact, and a movable contact arm. The movable contact arm includes a first end carrying the movable contact, a second end, and a pivot portion proximate the second end. A moving arm portion extends from the first end toward the pivot portion. The moving arm portion has a width, an upper edge, a lower edge, and a height defined by the distance between the upper edge and the lower edge. In response to a trip condition, the movable contact separates from the fixed contact and the movable contact arm pivots open at an angular opening velocity. The height of the moving arm portion of the movable contact arm is at least four times the width of the moving arm portion, thus minimizing the moment-of-inertia of the movable contact arm, and increasing the angular opening velocity.

22 Claims, 4 Drawing Sheets

ELECTRICAL SWITCHING APPARATUS CONTACT ASSEMBLY AND MOVABLE CONTACT ARM THEREFOR

BACKGROUND OF THE INVENTION

1. Field of the Invention

The invention relates generally to electrical switching apparatus and, more particularly, to contact assemblies for electrical switching apparatus, such as circuit breakers. The invention also relates to movable contact arms for circuit breaker contact assemblies.

2. Background Information

Electrical switching apparatus, such as circuit breakers, are employed in diverse capacities in power distribution systems such as, for example, to provide protection for electrical equipment from electrical fault conditions (e.g., without limitation, current overloads; short circuits; abnormal level voltage conditions).

As shown in FIGS. 1 and 2, a circuit breaker 2 (FIG. 1) generally includes a housing 4 which encloses a line conductor 6, a load conductor 8 (FIG. 1), a fixed contact 10 and a movable contact 12, with the movable contact 12 being movable into and out of electrical contact with the fixed contact 10. This switches the contacts 10, 12 of the circuit breaker 2 between the OFF or open position shown in FIG. 1, and the ON or closed position (as best shown in FIG. 3), or between the ON or closed position and a tripped or tripped off position (not shown). In the example shown, the fixed contact 10 is electrically connected to the line conductor 6 and the movable contact 12 is electrically connected to the load conductor 8 through a movable contact arm 16 by a suitable conductor, such as a flexible conductor (not shown). The circuit breaker 2 further includes an operating mechanism 14 (FIG. 1) having the movable contact arm 16 upon which the movable contact 12 is disposed. The movable contact arm 16 and movable contact 12 disposed thereon move past and/or through an arc chute 18 which includes a plurality of arc plates 20 structured to attract and dissipate the resultant arc which is formed when the movable contact 12 initially separates from the fixed contact 10 in response to the trip condition.

The movable contact arms of many known circuit breakers, such as movable contact arm 16 of circuit breaker 2 (FIG. 1) are made of solid copper or alloys of copper (e.g., silver bearing copper; a copper alloy with a relatively small percentage of silver), which are relatively good conductors of both electricity and heat, but which are not as strong as other materials. Hence, it is believed that relatively more copper than is necessary to handle the current (e.g., for thermal conductivity considerations) is typically employed in conventional movable contact arms 16 to handle the current and to provide the needed strength (e.g., rigidity). This undesirably adds weight, thus increasing the moment-of-inertia of the movable contact arm 16 and decreasing the performance of the circuit breaker 2. More specifically, the movement-of-inertia of the movable contact arm 16 significantly affects the angular opening velocity of the movable contact arm 16. It is known that the faster the movable contact arm 16 opening velocity is, the better the current-limiting capability of the circuit breaker 2. Therefore, it is desirable to maximize the opening velocity of the movable contact arm 16 in order to improve the short-circuit interruption performance of the circuit breaker 2. Previously, this has not been possible because material strength and thermal requirements have dictated the size and geometry of the movable contact arm 16.

For example, the movable contact arm 16 shown in FIGS. 1, 2, and 3 is a single-piece arm 16 made from copper, as previously noted. In order to achieve the desired strength, the length 22 (i.e., the distance between the pivot point of the arm 16 and the end carrying the movable contact 12) (FIGS. 1 and 2) of the movable contact arm 16 is required to be relatively short, and the width 24 (FIGS. 2 and 3) of the movable contact arm 16 must be relatively wide. Specifically, it is believed that the ratio of the width 24 to length 22 is about 1:7.3, or more. The width 24 (FIGS. 2 and 3) is also greater than desired with respect to the height 26 (FIG. 3) of the movable contact arm 16. Specifically, it is believed that the ratio of the width 24 to the height 26 is about 1:2, or more. The foregoing results in the weight and the movement-of-inertia of the movable contact arm 16 being greater than desired, and the aerodynamic efficiency of the movable contact arm 16 being less than desired, thus adversely affecting the angular opening velocity of the movable contact arm 16 and inhibiting the circuit interruption performance of the circuit breaker 2.

There is a need, therefore, to provide a movable contact arm 16 sized and shaped to optimize the angular opening velocity of the arm 16, while exhibiting sufficiently high strength and thermal conductivity, and low electrical resistivity.

It is also desirable to maximize the space or gap 28 (FIG. 1) between the movable and fixed contacts 10,12 in order to minimize the undesired continued flow of electrical current following the trip condition. Such current, commonly referred to as let-through current, must be minimized in order to protect electrical components from the harmful effects of over-current resulting from the trip condition.

There is, therefore, room for improvement in contact assemblies for electrical switching apparatus and in movable contact arms therefor.

SUMMARY OF THE INVENTION

These needs and others are met by embodiments of the invention which are directed to a movable contact arm for the contact assembly of an electrical switching apparatus, such as a circuit breaker. For example, through the use of lightweight, high-strength material(s), and by optimizing the size and shape of the movable contact arm to minimize the moment-of-inertia of the arm, the angular opening velocity of the arm is increased, thus improving the performance of the circuit breaker. The length of the arm may also be increased to increase the space or gap between the movable and fixed contacts of the contact assembly to further improve the circuit interruption performance of the electrical switching apparatus.

As one aspect of the invention, a movable contact arm is provided for a contact assembly of an electrical switching apparatus. The electrical switching apparatus includes a housing which encloses the contact assembly. The contact assembly includes a fixed contact and a movable contact separable from the fixed contact in response to a trip condition. The movable contact arm comprises: a first end structured to carry the movable contact of the contact assembly; a second end disposed distal from the first end; a pivot portion proximate the second end, the pivot portion having a first width; and a moving arm portion generally extending from the first end toward the pivot portion, the moving arm portion having a second width, wherein the movable contact arm has a moment-of-inertia and an angular opening velocity, and wherein the second width of the moving arm portion of the movable contact arm is less than the first width of the pivot portion of the movable contact arm, in order to minimize the moment-of-inertia of the movable contact arm, thereby increasing the angular opening velocity.

The moving arm portion may further comprise an upper edge, a lower edge, and a height defined by the distance between the upper edge and the lower edge, wherein the height of the moving arm portion is at least four times the second width of the moving arm portion. At least one of the upper edge of the moving arm portion and the lower edge of the moving arm portion may include at least one of a taper, a stepped portion, and a bevel in order to reduce the second width of the moving arm portion at the upper edge of the moving arm portion and/or the lower edge of the moving arm portion. The moving arm portion may also have a length, wherein the ratio of the second width of the moving arm portion to the length of the moving arm portion is about 1:9 to about 1:19. The pivot portion may comprise a number of spacers wherein each of the spacers has a width, and wherein the first width of the pivot portion of the movable contact arm includes the width of all of the spacers.

At least the moving arm portion of the movable contact arm may comprise a composite structure including at least two elongated members coupled together, side-by-side. Each of the elongated members may have a width wherein the width of a first one of the elongated members is different than the width of at least a second one of the elongated members, and wherein the second width of the moving arm portion of the movable contact arm comprises the combined width of all of the elongated members of the composite structure. A first one of the elongated members of the composite structure may be made from a different material than at least a second one of the elongated members of the composite structure. The elongated members of the composite structure may be coupled together without the use of separate mechanical fasteners.

The movable contact of the contact assembly may have a width which is greater than the second width of the moving arm portion of the movable contact arm. The movable contact arm may have a longitudinal axis, wherein the movable contact of the contact assembly is structured to be coupled to the movable contact arm at an angle with respect to the longitudinal axis of the movable contact arm in order that, when the movable contact arm is moved toward the closed position, the first end of the movable contact of the contact assembly engages the fixed contact of the contact assembly before the second end of the movable contact.

As another aspect of the invention, a contact assembly is provided for an electrical switching apparatus including a housing, a line conductor and a load conductor both structured to be housed by the housing, and an operating mechanism. The contact assembly comprises: a fixed contact structured to be electrically connected to one of the line conductor and the load conductor; a movable contact structured to be electrically connected to the other of the line conductor and the load conductor; and a movable contact arm comprising: a first end, the movable contact of the contact assembly being mounted at or about the first end of the movable contact arm, a second end disposed distal from the first end of the movable contact arm, a pivot portion proximate the second end of the movable contact arm, the pivot portion of the movable contact arm having a first width, and a moving arm portion generally extending from the first end of the movable contact arm toward the pivot portion of the movable contact arm, the moving arm portion of the movable contact arm having a second width, an upper edge, a lower edge, and a height, the height being defined by the distance between the upper edge of the moving arm portion of the movable contact arm and the lower edge of the moving arm portion, wherein the movable contact arm is operable between a closed position in which the movable contact of the contact assembly is in electrical contact with the fixed contact of the contact assembly, and an open position in which the movable contact arm and the movable contact disposed thereon are spaced from the fixed contact of the contact assembly, wherein in response to a trip condition, the operating mechanism of the electrical switching apparatus separates the movable contact from the fixed contact and pivots the movable contact arm from the closed position toward the open position at an angular opening velocity, wherein the movable contact arm has a moment-of-inertia, and wherein the height of the moving arm portion of the movable contact arm is at least about four times the second width of the moving arm portion, in order to minimize the moment-of-inertia of the movable contact arm, thereby increasing the angular opening velocity.

The electrical switching apparatus may comprise a circuit breaker including an operating mechanism having a crossbar with an aperture, and the pivot portion of the movable contact arm may further comprise a number of spacers, wherein the pivot portion of the movable contact arm is structured to pivotably engage the aperture of the crossbar with the spacers being disposed within the aperture of the crossbar. Each of the spacers may have a width, wherein the first width of the pivot portion of the movable contact arm, including the width of all of the spacers, is greater than the second width of the moving arm portion of the movable contact arm.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
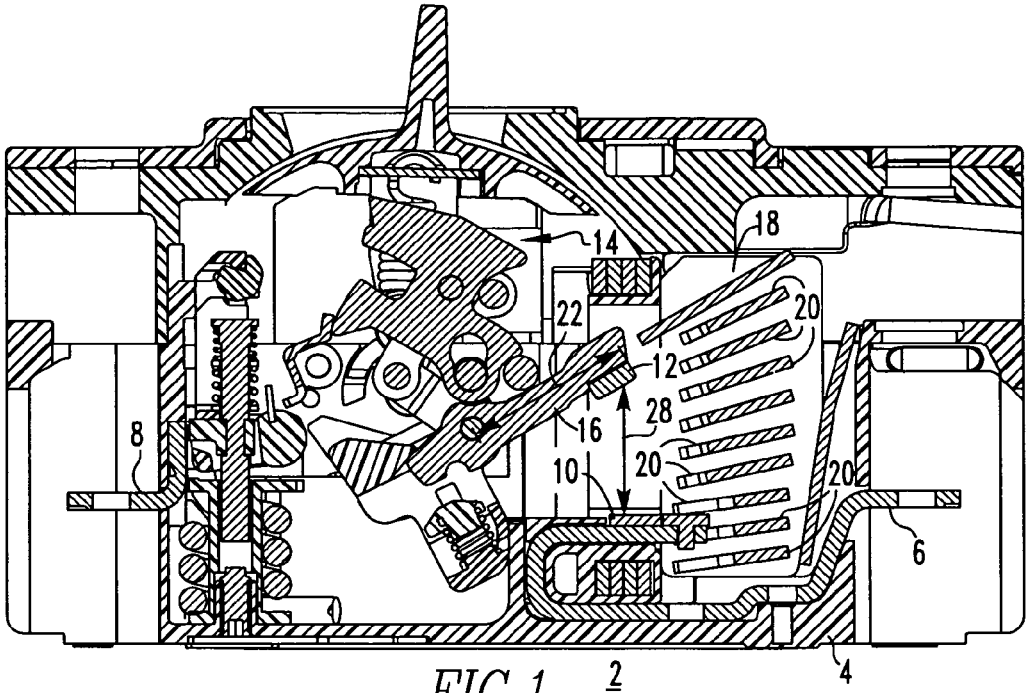
FIG.1 PRIOR ART
FIG. 1 is a cross-sectional view of a molded case circuit breaker, and contact assembly and movable contact arm therefor.

For purposes of illustration, embodiments of the invention will be described as applied to the contact assemblies of molded case circuit breakers (MCCBs), although it will become apparent that they could be applied to the contact assembly or assemblies of a wide variety of other types of electrical switching apparatus (e.g., without limitation, circuit switching devices and other interrupters, such as contactors, motor starters, motor controllers and other load controllers).

Directional phrases used herein, such as, for example, upper, lower and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts. Further, as employed herein, the statement that two or more parts are "attached"' shall mean that the parts are joined together directly.

As employed herein, the term "let-through current" refers to the peak electrical current (measured in amperes) which passes through an overcurrent protective device, such as, for example and without limitation, a circuit breaker, during an interruption. In circuit breaker design, it is desirable to minimize the amount of let-through current and resulting let-through energy. Such current, commonly referred to as let-through current, must be minimized in order to protect electrical components from the harmful effects of overcurrent resulting from the fault condition.

As employed herein, the term "short circuit interruption rating" is the maximum available fault current which a circuit breaker is designed to interrupt. By way of example, and without limitation, an industrial circuit breaker typically has a circuit interruption rating of up to about 100,000 A, wherein the available fault current in a single-family home is rarely above about 10,000 A.

As employed herein, the term "threshold current" refers to the minimum current that causes the separable contacts to begin parting.

As employed herein, the term "contact gap" refers to the distance or measurement of the space between the separable contacts (i.e., the fixed contact and the movable contact) of the circuit breaker or other known or suitable electrical switching apparatus when the circuit breaker is open.

As employed herein, the term "number" means one or an integer greater than one (i.e., a plurality).

Figure 2:
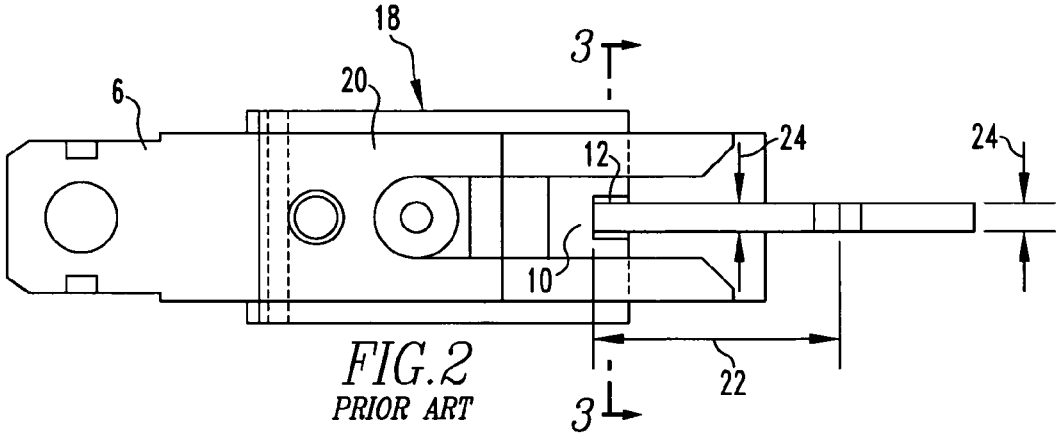
FIG.2 PRIOR ART
FIG. 2 is a top plan view of the contact assembly and movable contact arm therefor of FIG. 1, modified to show the movable contact arm in the closed position.
Figure 3:
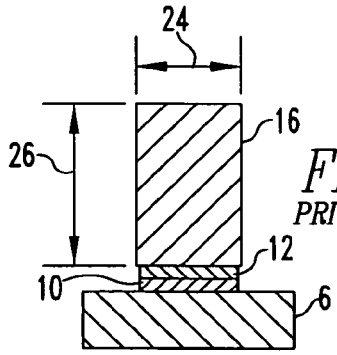
FIG.3 PRIOR ART
FIG. 3 is a cross-sectional view taken along line 3—3 of FIG. 2, with the arc chute not being shown for simplicity of illustration.

Among other improvements, the movable contact arms disclosed herein have been designed to reduce the moment-of-inertia of the arm as compared to known movable contact arm designs (e.g., without limitation, movable contact arm 16 of FIGS. 1–3). As a result, a number of important parameters of circuit breaker performance have been improved, expressly including, without limitation, the angular opening velocity of the movable contact arm, the let-through current, the short circuit interruption rating, the threshold, and the contact gap. The following Examples disclose several ways of accomplishing these results.

Figure 7A:
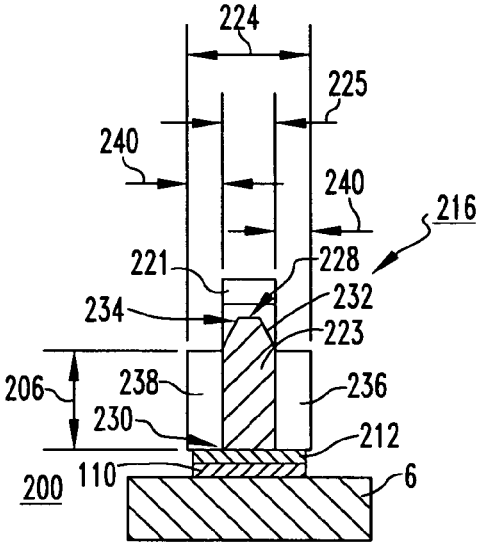
FIG. 7A is a cross-sectional view of a contact assembly and movable contact arm therefor, in accordance with another embodiment of the invention.
Figure 7B:
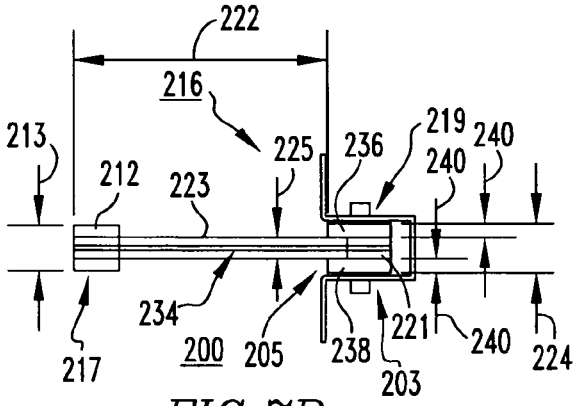
FIG. 7B is a top plan view of the movable contact arm of FIG. 7A, also showing the circuit breaker crossbar in simplified form.
Figure 8A:
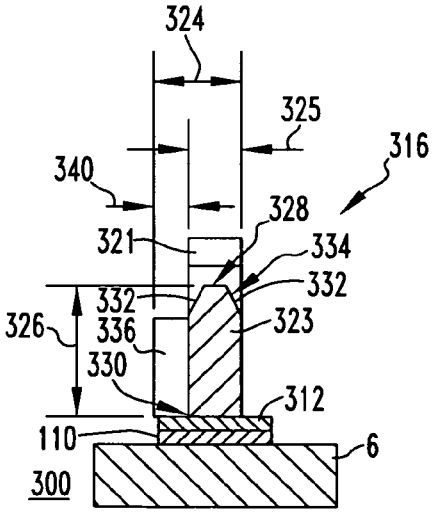
FIG. 8A is a cross-sectional view of a contact assembly and movable contact arm therefor, in accordance with another embodiment of the invention.
Figure 8B:
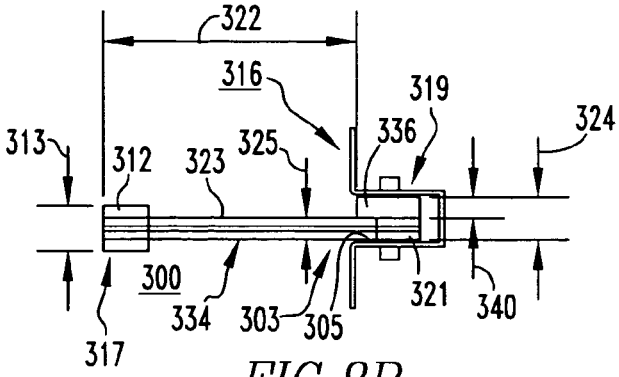
FIG. 8B is a top plan view of the movable contact arm of FIG. 7A, also showing the circuit breaker crossbar in simplified form.

In each example shown and described herein, like components are numbered similarly. For example, the various components of the contact assembly embodiment shown and described with respect to FIGS. 4–6 below are numbered with 100 series reference numbers, whereas the embodiment of FIGS. 7A and 7B is numbered similarly but with 200 series reference numbers, the embodiment of FIGS. 8A and 8B is numbered similarly but with 300 series reference numbers, and so on. For simplicity of disclosure, similar features present in more than one embodiment of the invention are shown, but may not be repetitively discussed.

EXAMPLE 1

Figure 4:
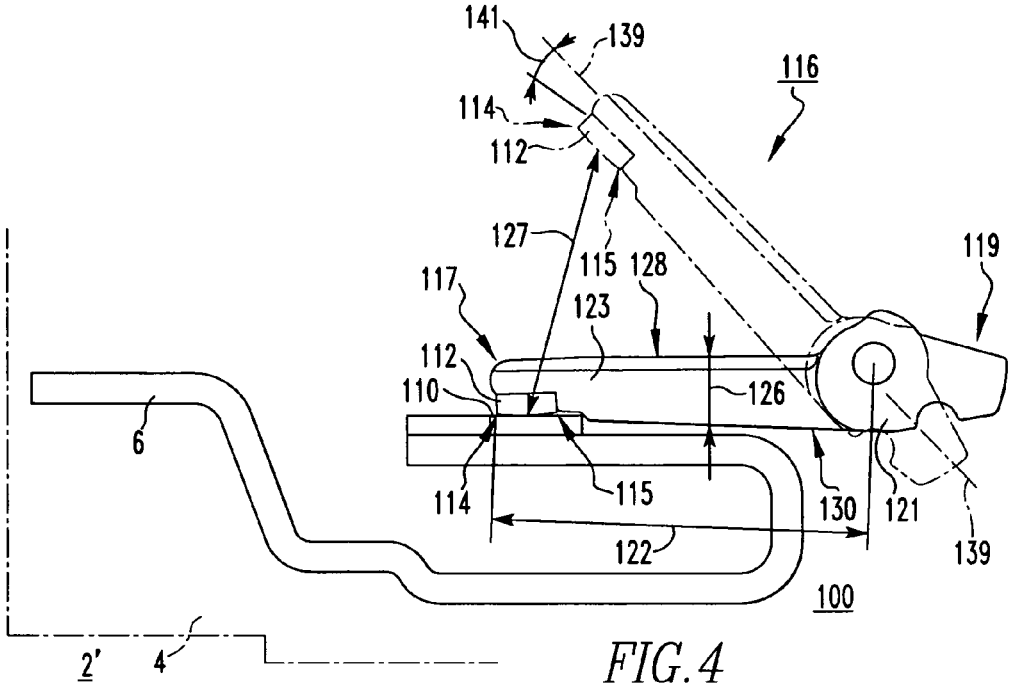
FIG. 4 is a vertical elevational view of a contact assembly for a circuit breaker in accordance with an embodiment of the invention, with the movable contact arm shown in the closed position in solid line drawing and in the open position in phantom line drawing.
Figure 5:
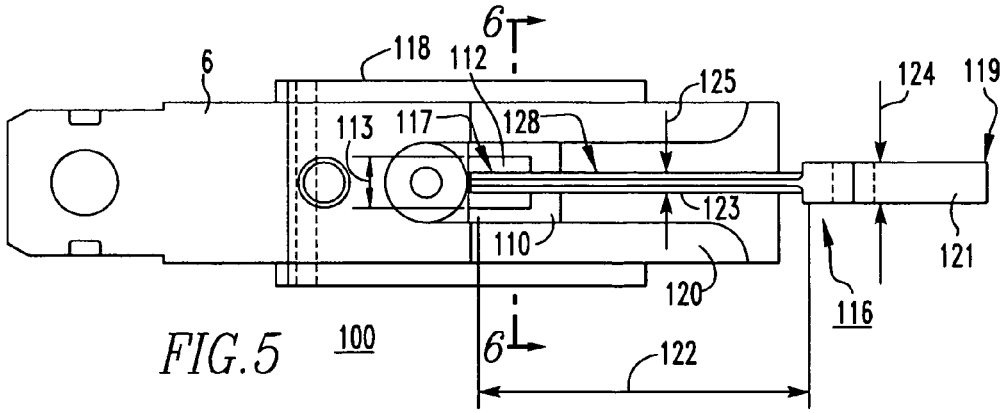
FIG. 5 is a top plan view of the contact assembly and movable contact therefor of FIG. 4, also showing an arc chute in simplified form.
Figure 6:
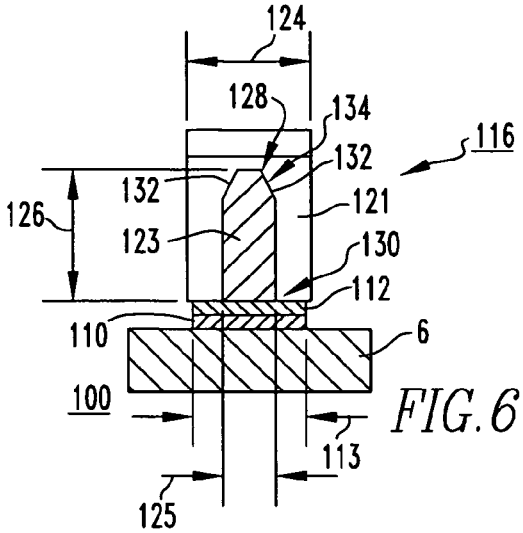
FIG. 6 is a cross-sectional view taken along line 6—6 of FIG. 5, with the arc chute not being shown for simplicity of illustration.

FIGS. 4, 5, and 6 show a contact assembly 100 including a movable contact arm 116 as employed in a molded case circuit breaker (MCCB) 2, partially shown in FIG. 4. It will be appreciated that, except for the contact assembly 100, which will now be discussed, the MCCB 2', (FIG. 4) is, otherwise, substantially identical to the MCCB 2 shown and previously described with respect to FIG. 1.

The contact assembly 100 includes a fixed contact 110 which is coupled to the folded back line conductor 6 housed within the housing 4 (FIG. 4) of the MCCB 2' (FIG. 4), and a movable contact 112 which is mounted on the movable contact arm 116. Electrical connection of the movable contact arm 116 to the load conductor 8 (not shown) (see, for example, FIG. 1) of the MCCB 2' is provided in the same manner as movable contact arm 16 of FIG. 1. The movable contact arm 116 has a first end structured to carry the movable contact 112, a second end 119 disposed distal from the first end 117, a pivot portion 121 proximate the second end 119, and a moving arm portion 123 which generally extends from the first end 117 toward the pivot portion 121.

The pivot portion 121 has a first width 124, and the moving arm portion 123 has a second width 125, wherein the second width 125 of the moving arm portion 123 is less than the first width 124 of the pivot portion 121. This reduces the amount of material required for the movable contact arm 16, thus reducing the mass of the movable contact arm 16 and accomplishing the objective of minimizing the moment-of-inertia of the movable contact arm 116. This, in turn, increases the angular opening velocity of the movable contact arm 116.

As best shown in FIG. 6, the moving arm portion 123 of the movable contact arm 16 has an upper edge 128, a lower edge 130, and a height 126 defined by the distance between the upper edge 128 and the lower edge 130. The height 126 of the moving arm portion 123 of the example movable contact arm 116 is at least about four times the second width 125 of the moving arm portion 123. Thus, the ratio of second width 125 to height 126 is about 1:4. which is substantially less than the width-to-height ratio of known movable contact arms, such as movable contact arm 16 of FIGS. 1–3, which has only one arm width 24 and a ratio of width 24 to height 26 of about 1:2 (best shown in FIG. 3). It will be appreciated that the exact dimensions of the various portions of the movable contact arm (e.g., pivot portion 121; moving arm portion 123; upper edge 128; lower edge 130) are not meant to be limiting upon the scope of the invention. Specifically, the particular electrical application in which the movable contact arm 116 will be employed will dictate what arm dimensions are necessary to achieve the predetermined circuit breaker parameters (e.g., without limitation, let-through current; short circuit interruption rating; threshold; contact gap) of the application. Accordingly, it will be appreciated, for example, that in other embodiments of the invention the height 126 of the moving arm portion 123 may be slightly less than four times (e.g., without limitation, 3.7 times) the second width 125 of the moving arm portion 123.

At least one of the upper edge 128 and the lower edge 130 of the moving arm portion 123 can include at least one taper 132 and/or a bevel 134, in order to reduce the second width 125 of the moving arm portion 123 of at least one of the upper edge 128 and the lower edge 130 of the moving arm portion 123. The example movable contact arm 116 of FIGS. 4–6 has an upper edge 128 which includes two side tapers 132 comprising a bevel 134 (best shown in the cross-sectional view of FIG. 6). It will, however, be appreciated that the movable contact arm 116 could have a taper 132 and/or bevel 134 and/or any other suitable geometry at on or both of upper edge 128 and the lower edge 130 of the moving arm portion 123. For example and without limitation, as will be discussed in connection with FIGS. 12A and 12B hereinbelow, the moving arm portion 723 could include a stepped portion (see, for example, stepped portion 732 of moving arm portion 723 of movable contact arm 716 of FIG. 12B).

Reducing the second width 125 at the upper edge 128 further improves the angular opening velocity of the movable contact arm 16, not only by further weight reduction of the arm 116, but also by providing relatively less material at the upper edge 128 for current to flow through, thereby forcing current down toward the lower edge 130. This results in the electric current which is flowing in opposite directions in the folded back line conductor 6 and the movable contact arm 16, being closer to each other, thereby advantageously creating an increased repulsion force on the movable contact arm 116 to propel it open.

Another significant aspect of embodiments of the invention relates to the length 122 (FIGS. 4 and 5) of the movable contact arm 116. Specifically, in the example of FIGS. 4–6, the ratio of the second width 125 of the moving arm portion 123 of the movable contact arm 116 to the length 122 of the moving arm portion 123 is preferably about 1:9 to about 1:19. It was previously believed that such a width-to-length ratio was not possible, for example, in view of limitations of the strength and conductive properties of known materials commonly used for movable contact arms. Accordingly, this is a significant increase over known movable contact arm designs. For example, as previously discussed, movable contact arm 16 of FIGS. 1–3 has a width 24 to length 22 ratio of about 1:7.3. One advantageous result of this ratio difference is an increase in the contact gap 127 (FIG. 4). In other words, the separation distance between the movable contact 112 and the fixed contact 110 when the movable contact arm 116 is in the open position, shown in phantom line drawing in FIG. 4, is increased with respect to known movable contact arms (see, for example, contact gap 28 of movable contact arm 16 of FIG. 1). Among other advantages, this reduces the amount of let-through current of the circuit breaker.

Another unique aspect of embodiments of the invention is best shown in FIG. 4. Specifically, the movable contact 112 has a first end 114 and a second end 115, and the movable contact arm 116 has a longitudinal axis 139. The movable contact 112 is coupled to the movable contact arm 116 such that it forms an angle 141 with respect to the longitudinal axis 139, as shown. This results in the first end 114 of the movable contact 112 engaging the fixed contact 110 of the contact assembly 100 before the second end 115 of the movable contact, when the movable contact arm 116 is pivoted to the closed position, shown in solid line drawing in FIG. 4. The exact dimension of the angle 141 is not meant to limit the scope of the invention.

As shown in FIG. 5, the movable contact arm 116 of the example contact assembly 100 pivots through an arc chute 118 having suitable narrow-channel arc plates 120. In other words, the arc plates 120 are shaped and configured to provide a relatively narrow channel through which the movable contact 112 and the first end 114 of the movable contact arm 116 travel in response to a trip condition. This shape (e.g., without limitation, generally U-shape) and configuration (e.g., without limitation, narrow channel for receiving the contact arm 116) function to attract the arc (not shown) which is formed in response to the trip condition, in order that it is retained in the arc chute 118 and is extinguished.

EXAMPLE 2

As a non-limiting example, the moving arm portion 123 of the movable contact arm 116 of FIGS. 4–6 has a length 122 of about 1.168 inches, a second width 125 of about 0.062 inches, and a height 126 of about 0.250 inches.

EXAMPLE 3

FIGS. 7A and 7B show cross-sectional and top plan views, respectively, of a contact assembly 200 having a movable contact arm 216 substantially similar to movable contact arm 116 previously discussed in connection with FIGS. 4–6, but having a pivot portion 221 which comprises a number of spacers 236,238. Specifically, the example pivot portion 221 includes a pair of spacers 236,238 disposed on opposite sides of the moving arm portion 223 of the movable contact arm 216 proximate the second end 219 of the movable contact arm. Each of the spacers 236,238 has a width 240, wherein the first width 224 of the pivot portion 221 of the movable contact arm 216 includes the combined width 240 of all of the spacers (e.g., spacers 236,238), along with the second width 225 of the moving arm portion 223.

The pivot portion 221 pivotably couples the movable contact arm 216 to the crossbar 203 (shown in simplified form in FIG. 7B) of the circuit breaker operating mechanism 14 (FIG. 1). As shown in simplified form in FIG. 7B, the crossbar 203 includes an aperture 205. The spacers 236,238 are disposed within the aperture 205 of the crossbar 203 in order to account for the reduced width of the movable contact arm 216 while permitting the arm 216 to be used without requiring modification to the crossbar 203. In other words, the spacers 236,238 occupy any excess space within the aperture 205 of the crossbar 203 and provide for proper alignment of the movable contact arm 216 pivotably coupled thereto.

EXAMPLE 4

It will be appreciated that the spacers 236,238 could be made from any known or suitable material. For example and without limitation, the spacers 236.238 could comprise Belleville washers (not shown). It will also be appreciated that any suitable number and configuration of spacers (e.g., 236,238) could be employed within the aperture 205 of the crossbar 203, without departing from the scope of the invention.

EXAMPLE 5

For example, as shown in FIGS. 8A and 8B, the pivot portion 321 of the movable contact arm 316 could alternatively comprise a single spacer 336 having a width 340 which is greater than the widths 240 of the individual spacers 236,238 of FIGS. 7A and 7B, previously discussed. The first width 324 of the pivot portion 321 of the movable contact arm 316 includes, in part, width 340 of the spacer 336 such that the pivot portion 321 fits securely within the aperture 305 of the circuit breaker crossbar 303, and is properly aligned, as shown in FIG. 8B.

EXAMPLE 6

As shown in FIGS. 5–6, 7B, 8B, 9, 10, 11, and 12A–12B, respectively, the movable contact 112,212,312,412,512,612,712 has a width 113,213,313,413,513,613,713 which can be greater than the second width 125,225,325,425,525,625,725 of the moving arm portion 123,223,323,423,523,623,723 of the movable contact arm 116,216,316,416,516,616,716.

EXAMPLE 7

At least the moving arm portion 423,523,623,723 of the movable contact arm 416,516,616,716 may comprise a composite structure 450,550,650,750 including at least two elongated members 452,545,552,554,652,654,752,754 coupled together side-by-side. It will be appreciated that each of the elongated members 452,545,552,554,652,654,752,754 of the composite structure 450,550,650,750 may be made from the same or different materials.

EXAMPLE 8

The elongated members 452,545,552,554,652,654,752,754 of the composite structure 450,550,650,750 are preferably coupled together without the use of mechanical fasteners. It will be appreciated that this may be accomplished using any known or suitable fastening process or mechanism, such as, for example and without limitation, soldering, brazing or welding, such as cold welding, ultrasonic welding, or resistance welding.

EXAMPLE 9

Figure 9:
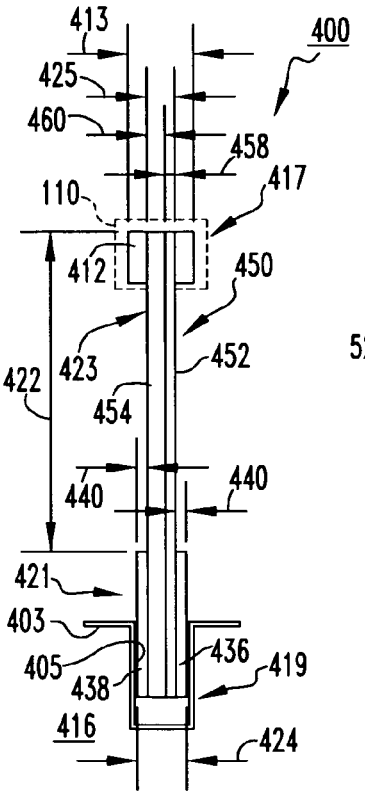
FIGS. 9–11 are top plan views of laminate movable contact arms in accordance with embodiments of the invention.

FIG. 9 shows a movable contact arm 416 wherein the composite structure 450 includes two elongated members 452,454 suitably coupled side-by-side, and wherein the first elongated member 452 has a first width 458 and the second elongated member 454 has a second width 460. The second width 460 of second elongated member 454 is different (e.g., greater) than the first width 458 of the first elongated member 452. In this manner, two different materials could be employed to form the composite structure 450 having the desired strength and conductive properties, while maintaining the desired second width 425 of the moving arm portion 423 and length 422, for example, of the movable contact arm 416.

The pivot portion 421 of the example movable contact arm 416 includes two spacers 436,438 adjacent the first and second elongated members 452,454 of the composite structure 450, respectively. The spacers 436,438 have the same width 440, and function to properly align the movable contact arm 416 within the aperture 405 of the circuit breaker crossbar 403 (shown in simplified form).

EXAMPLE 10

Figure 10:
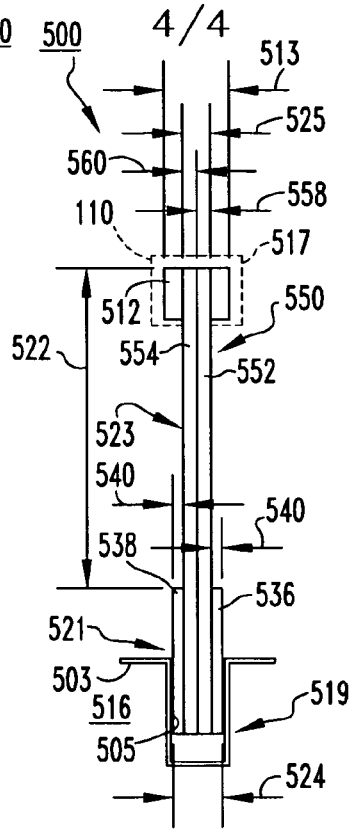

FIG. 10 shows a movable contact arm 516 wherein the composite structure 550 includes two elongated members 552,554 suitably coupled side-by-side, and having first and second widths 558,560, which are the same.

Like pivot portion 421 of movable contact arm 416 of FIG. 9, the pivot portion 521 of movable contact arm 516 includes two spacers 536,538 disposed adjacent the first and second elongated members 552,554, respectively, and having the same width 540 to properly align the movable contact arm 56 within the aperture 505 of the circuit breaker crossbar 503 (shown in simplified form). It will, however, be appreciated that in other embodiments of the invention the widths could be different.

EXAMPLE 11

Figure 11:
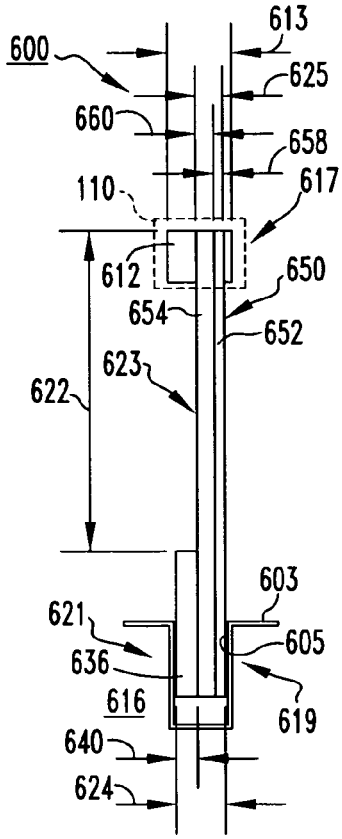

FIG. 11 shows a movable contact arm 616 wherein the composite structure 650, like composite structure 450 of FIG. 9, includes two elongated members 652,654 suitably coupled side-by-side, and having different first and second widths 658,660. However, the pivot portion 621, unlike pivot portion 421 of movable contact arm 416 of FIG. 9, includes only one spacer 636, which is disposed adjacent the first elongated member 654. The spacer has the appropriate width 640 to properly align the movable contact arm 616 within the aperture 605 of the circuit breaker crossbar 603 (shown in simplified form).

EXAMPLE 12

Figure 12A:
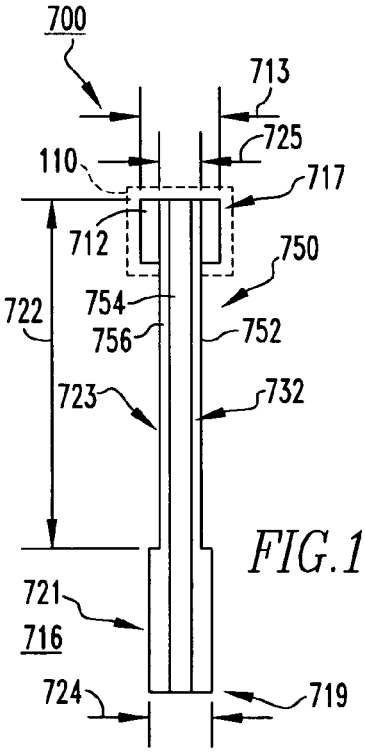
FIG. 12A is a top plan view of a movable contact arm having a coined portion in accordance with another embodiment of the invention.
Figure 12B:
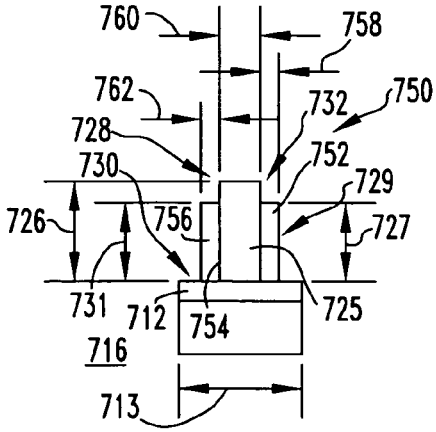
FIG. 12B is an end elevational view of the movable contact arm of FIG. 12A.

FIGS. 12A and 12B show a movable contact arm 716 wherein the composite structure 750 comprises a first elongated member 752 having a first height 727 (FIG. 12B), a second elongated member 754 having a second height 726 (FIG. 12B), and a third elongated member 756 having a third height 731. The composite structure 750 also includes a cross-section (FIG. 12B) having an upper edge 728, a lower edge 730, and an intermediate portion 729 (FIG. 12B).

The second elongated member 754 is disposed between, and suitably coupled to, the first and third elongated members 752,756. The first height 727 of the first elongated member 752 and the third height 731 of the third elongated member 756 are substantially the same, and are less than the second height 726 of the second elongated member 754, as best shown in FIG. 12B. In this manner, the upper edge 728 of the composite structure 750 includes a stepped portion 732 so that the width 760 of the upper edge 728 of the cross-section is less than the combined widths 758,760,762 of the intermediate portion 729 of the cross-section. This stepped portion 732 affords the same advantages (e.g., magnetic propulsion) as those previously discussed with respect to tapers 132 and bevel 134 of movable contact arm 116 of FIGS. 4–6.

EXAMPLE 13

It will be appreciated that the stepped portion 732 of the composite structure 750 may alternatively be produced by, for example, coining the composite structure 750 at the moving arm portion 723 thereof, in order to reduce the respective heights 727,726 and/or widths 758,762 of at least the first and third elongated members 752,756 of the composite structure. In this manner, the pivot portion 721 of the movable contact arm 716 may have the effect of spacers, such as spacers 536,538 of movable contact arm 516 of FIG.

10, previously discussed, without requiring a separate spacer component. In other words, the portions of the first and third elongated members 752,756, which have not been coined or otherwise suitably reduced in width and/or height, comprise the first width 724 of the pivot portion 721, which is greater than the second width 725 of the moving arm portion 723 of the movable contact arm 716 that has been coined or otherwise suitably reduced in width and/or height.

EXAMPLE 14

A wide range of other suitable contact arm geometries, other than those shown and described herein, could be employed without departing from the scope of the invention.

EXAMPLE 15

A wide range of suitable movable contact arm materials may be employed. For example, a suitable relatively good conductive material (e.g., without limitation, copper) may be used side-by-side in combination with a suitably high-strength material with reasonably good thermal properties (e.g., without limitation, aluminum), in order to reinforce the relatively good conductive material.

EXAMPLE 16

Furthermore, there are a wide range of suitable alloys of these materials that work with various suitable tempers and hardnesses. For example, suitable example copper alloys include C11000, C17510, C15725, C17200, C17000, C17500, C17460, and C17410, although it will be appreciated that other suitable light-weight, high-strength alloys and other suitable metallic and/or non-metallic materials (e.g., without limitation, suitable aluminum alloys) could be employed in any known or suitable configuration.

EXAMPLE 17

An intermediate layer (e.g., brass) (not shown) may be advantageously employed to bridge the difference in the coefficient of thermal expansion (CTE) between the two different movable contact arm materials of the composite structure to prevent, for example, delamination or cracking of the interface therebetween, especially if welding or brazing is employed to join the different materials. Furthermore, one or more of the materials may also be plated (e.g., nickel plated), in order to improve bonding characteristics.

The disclosed contact assemblies 100,200,300,400,500, 600,700 provide movable contact arms 116,216,316,416, 516,616,716 which improve circuit breaker performance by, among other things, increasing the angular opening velocity of the movable contact arm. This is achieved through use of a suitable relatively lightweight, yet relatively strong, current-carrying material, in an optimized configuration (e.g., size; shape; orientation), in order to reduce the moment-of-inertia of the arm. The design may also focus the magnetic field with respect to the movable contact arm, in order to propel it open, and it may provide a relatively longer arm than is known, in order to increase the available gap (i.e., space) between the fixed and movable contacts, when they are separated. A composite structure employing two or more elongated members side-by-side may also be employed, and the disclosed movable contact arm designs may also be readily incorporated into existing circuit breakers without any changes to existing moldings or to the operating mechanisms. For example, one or more spacers may be employed at the pivot portion of the movable contact arm to provide proper alignment within the existing crossbar of the circuit breaker operating mechanism. Accordingly, the disclosed movable contact arm designs allow for low-cost, mass production quantities suitable for MCCBs while still maintaining desirable current carrying, thermal, and interruption properties.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A movable contact arm for a contact assembly of an electrical switching apparatus, said electrical switching apparatus including a housing enclosing said contact assembly, said contact assembly including a fixed contact and a movable contact separable from said fixed contact in response to a trip condition, said movable contact arm comprising:

a first end structured to carry said movable contact of said contact assembly;

a second end disposed distal from the first end;

a pivot portion proximate the second end, said pivot portion having a first side, a second side, and a first width, said first width being defined by the distance between the first side and the second side; and a moving arm portion generally extending from the first end toward said pivot portion, said moving arm portion having a second width, wherein said movable contact arm has a moment-of-inertia and an angular opening velocity, wherein said second width of said moving arm portion of said movable contact arm is less than said first width of said pivot portion of said movable contact arm, in order to minimize said moment-of-inertia of said movable contact arm, thereby increasing said angular opening velocity, and wherein said pivot portion is substantially devoid of a gap between the first side of said pivot portion and the second side of said pivot portion.

2. The movable contact arm of claim 1 wherein said moving arm portion of said movable contact arm has a length; and wherein the ratio of said second width of said moving arm portion to said length of said moving arm portion is about 1:9 to about 1:19.

3. The movable contact arm of claim 1 wherein said pivot portion comprises a number of spacers; wherein each of said spacers has a width; and wherein said first width of said pivot portion of said movable contact arm includes the width of all of said spacers.

4. The movable contact arm of claim 1 wherein at least said moving arm portion of said movable contact arm comprises a composite structure including at least two elongated members coupled together, side-by-side.

5. The movable contact arm of claim 4 wherein said at least two elongated members of said composite structure are coupled together without the use of separate mechanical fasteners.

6. The movable contact arm of claim 1 wherein said movable contact of said contact assembly has a width; wherein said movable contact arm is structured to carry said movable contact at or about the first end of said movable contact arm; and wherein the width of said movable contact is greater than said second width of said moving arm portion of said movable contact arm.

7. The movable contact arm of claim 1 wherein said movable contact arm is operable between a closed position in which said movable contact of said contact assembly is in electrical contact with said fixed contact of said contact assembly, and an open position in which said movable contact arm and said movable contact disposed thereon are spaced from said fixed contact; wherein said movable contact of said contact assembly has a first end and a second end; wherein said movable contact arm has a longitudinal axis; and wherein said movable contact of said contact assembly is structured to be coupled to said movable contact arm at an angle with respect to said longitudinal axis of said movable contact arm in order that, when said movable contact arm is moved toward said closed position, the first end of said movable contact of said contact assembly engages said fixed contact of said contact assembly before the second end of said movable contact.

8. The movable contact arm of claim 1 wherein said movable contact arm is made from at least one copper alloy selected from the group consisting of C11000, C15725, C17000, C17200, C17410, C17460 and C17500.

9. A movable contact arm for a contact assembly of an electrical switching apparatus, said electrical switching apparatus including a housing enclosing said contact assembly, said contact assembly including a fixed contact and a movable contact separable from said fixed contact in response to a trip condition, said movable contact arm comprising:

a first end structured to carry said movable contact of said contact assembly;

a second end disposed distal from the first end;

a pivot portion proximate the second end, said pivot portion having a first width; and a moving arm portion generally extending from the first end toward said pivot portion, said moving arm portion having a second width, wherein said movable contact arm has a moment-of-inertia and an angular opening velocity, wherein said second width of said moving arm portion of said movable contact arm is less than said first width of said pivot portion of said movable contact arm, in order to minimize said moment-of-inertia of said movable contact arm, thereby increasing said angular opening velocity, and wherein said moving arm portion further comprises an upper edge, a lower edge, and a height defined by the distance between said upper edge of said moving arm portion and said lower edge of said moving arm portion; and wherein the height of said moving arm portion is at least four times said second width of said moving arm portion.

10. The movable contact arm of claim 9 wherein at least one of said upper edge of said moving arm portion and said lower edge of said moving arm portion includes at least one of a taper, a stepped portion, and a bevel in order to reduce said second width of said moving arm portion at said at least one of said upper edge of said moving arm portion and said lower edge of said moving arm portion.

11. A movable contact arm for a contact assembly of an electrical switching apparatus, said electrical switching apparatus including a housing enclosing said contact assembly, said contact assembly including a fixed contact and a movable contact separable from said fixed contact in response to a trip condition, said movable contact arm comprising:

a first end structured to carry said movable contact of said contact assembly;

a second end disposed distal from the first end;

a pivot portion proximate the second end, said pivot portion having a first width; and a moving arm portion generally extending from the first end toward said pivot portion, said moving arm portion having a second width, wherein said movable contact arm has a moment-of-inertia and an angular opening velocity, wherein said second width of said moving arm portion of said movable contact arm is less than said first width of said pivot portion of said movable contact arm, in order to minimize said moment-of-inertia of said movable contact arm, thereby increasing said angular opening velocity, wherein at least said moving arm portion of said movable contact arm comprises a composite structure including at least two elongated members coupled together, side-by-side, and wherein each of said at least two elongated members of said composite structure has a width; wherein the width of a first one of said at least two elongated members of said composite structure is different than the width of at least a second one of said at least two elongated members of said composite structure; and wherein said second width of said moving arm portion of said movable contact arm comprises the combined width of all of said elongated members of said composite structure.

12. A movable contact arm for a contact assembly of an electrical switching apparatus, said electrical switching apparatus including a housing enclosing said contact assembly, said contact assembly including a fixed contact and a movable contact separable from said fixed contact in response to a trip condition, said movable contact arm comprising:

a first end structured to carry said movable contact of said contact assembly;

a second end disposed distal from the first end;

a pivot portion proximate the second end, said pivot portion having a first width; and a moving arm portion generally extending from the first end toward said pivot portion, said moving arm portion having a second width, wherein said movable contact arm has a moment-of-inertia and an angular opening velocity, wherein said second width of said moving arm portion of said movable contact arm is less than said first width of said pivot portion of said movable contact arm, in order to minimize said moment-of-inertia of said movable contact arm, thereby increasing said angular opening velocity, wherein at least said moving arm portion of said movable contact arm comprises a composite structure including at least two elongated members coupled together, side-by-side, and wherein a first one of said at least two elongated members of said composite structure is made from a different material than at least a second one of said at least two elongated members of said composite structure.

13. A movable contact arm for a contact assembly of an electrical switching apparatus, said electrical switching apparatus including a housing enclosing said contact assembly, said contact assembly including a fixed contact and a movable contact separable from said fixed contact in response to a trip condition, said movable contact arm comprising:

a first end structured to carry said movable contact of said contact assembly;

a second end disposed distal from the first end;

a pivot portion proximate the second end, said pivot portion having a first width; and a moving arm portion generally extending from the first end toward said pivot portion, said moving arm portion having a second width, wherein said movable contact arm has a moment-of-inertia and an angular opening velocity, wherein said second width of said moving arm portion of said movable contact arm is less than said first width of said pivot portion of said movable contact arm, in order to minimize said moment-of-inertia of said movable contact arm, thereby increasing said angular opening velocity wherein at least said moving arm portion of said movable contact arm comprises a composite structure including at least two elongated members coupled together, side-by-side, and wherein said composite structure includes a cross-section having an upper edge, a lower edge, and an intermediate portion between said upper edge and said lower edge; wherein said composite structure comprises a first elongated member having a first height, a second elongated member having a second height, and a third elongated member having a third height; wherein the second height of said second elongated member is greater than the first height of said first elongated member and the third height of said third elongated member; and wherein said second elongated member is disposed between said first elongated member and said third elongated member, in order that at least one of said upper edge of said cross-section of said composite structure and said lower edge of said cross-section of said composite structure has a width which is less than said width of said intermediate portion of said cross-section.

14. A contact assembly for an electrical switching apparatus including a housing, a line conductor and a load conductor both structured to be housed by said housing, and an operating mechanism, said contact assembly comprising:

a fixed contact structured to be electrically connected to one of said line conductor and said load conductor;

a movable contact structured to be electrically connected to the other of said line conductor and said load conductor; and a movable contact arm comprising:

a first end, said movable contact of said contact assembly being mounted at or about the first end of said movable contact arm, a second end disposed distal from the first end of said movable contact arm, a pivot portion proximate the second end of said movable contact arm, said pivot portion of said movable contact arm having a first width, and a moving arm portion generally extending from the first end of said movable contact arm toward said pivot portion of said movable contact arm, said moving arm portion of said movable contact arm having a second width, an upper edge, a lower edge, and a height, said height being defined by the distance between said upper edge of said moving arm portion of said movable contact arm and said lower edge of said moving arm portion, wherein said movable contact arm is operable between a closed position in which said movable contact of said contact assembly is in electrical contact with said fixed contact of said contact assembly, and an open position in which said movable contact arm and said movable contact disposed thereon are spaced from said fixed contact of said contact assembly, wherein in response to a trip condition, said operating mechanism of said electrical switching apparatus separates said movable contact from said fixed contact and pivots said movable contact arm from said closed position toward said open position at an angular opening velocity, wherein said movable contact arm has a moment-of-inertia, and wherein said height of said moving arm portion of said movable contact arm is at least about four times said second width of said moving arm portion, in order to minimize said moment-of-inertia of said movable contact arm, thereby increasing said angular opening velocity.

15. The contact assembly of claim 14 wherein at least one of said upper edge of said moving arm portion of said movable contact arm and said lower edge of said moving arm portion of said movable contact arm includes at least one of a taper, a stepped portion, and a bevel in order to reduce said second width of said moving arm portion at said at least one of said upper edge of said moving arm portion and said lower edge of said moving arm portion.

16. The contact assembly of claim 14 wherein said moving arm portion of said movable contact arm has a length; and wherein the ratio of said second width of said moving arm portion of said movable contact arm to said length of said moving arm portion of said movable contact arm is about 1:9 to about 1:19.

17. The contact assembly of claim 14 wherein said second width of said moving arm portion of said movable contact arm is less than said first width of said pivot portion of said movable contact arm.

18. The contact assembly of claim 14 wherein at least said moving arm portion of said movable contact arm comprises a composite structure including at least two elongated members coupled together, side-by-side; and wherein said at least two elongated members of said composite structure are coupled together without the use of separate mechanical fasteners.

19. The contact assembly of claim 18 wherein each of said at least two elongated members of said composite structure has a width; wherein the width of a first one of said at least two elongated members of said composite structure is different than the width of at least a second one of said at least two elongated members of said composite structure; and wherein said second width of said moving arm portion of said movable contact arm comprises the combined width of all of said elongated members of said composite structure.

20. The contact assembly of claim 14 wherein said movable contact of said contact assembly has a width; wherein said movable contact is disposed at or about the first end of said movable contact arm; and wherein the width of said movable contact is greater than said second width of said moving arm portion of said movable contact arm.

21. The contact assembly of claim 14 wherein said movable contact of said contact assembly has a first end and a second end; wherein said movable contact arm has a longitudinal axis; and wherein said movable contact of said contact assembly is coupled to said movable contact arm at an angle with respect to said longitudinal axis of said movable contact arm in order that, when said movable contact arm is moved toward said closed position, the first end of said movable contact of said contact assembly engages said fixed contact of said contact assembly before the second end of said movable contact.

22. The contact assembly of claim 14 wherein said electrical switching apparatus comprises a circuit breaker including an operating mechanism; wherein said operating mechanism of said circuit breaker comprises a crossbar having an aperture; wherein said pivot portion of said movable contact arm further comprises a number of spacers; wherein said pivot portion of said movable contact arm is structured to pivotably engage said aperture of said crossbar with said spacers being disposed within said aperture of said crossbar; wherein each of said spacers has a width; and wherein said first width of said pivot portion of said movable contact arm, including the width of all of said spacers, is greater than the second width of said moving arm portion of said movable contact arm.

* * * * *